US008434569B2

(12) United States Patent
Reddoch, Sr.

(10) Patent No.: US 8,434,569 B2
(45) Date of Patent: May 7, 2013

(54) SHORT MUD SAVER FOR USE WITH TOP DRIVE OR KELLY

(76) Inventor: Jeffrey A. Reddoch, Sr., Lafayette, LA (US)

( * ) Notice: Subject to any disclaimer, the term of this patent is extended or adjusted under 35 U.S.C. 154(b) by 338 days.

(21) Appl. No.: 12/903,029

(22) Filed: Oct. 12, 2010

(65) Prior Publication Data

US 2011/0083904 A1 Apr. 14, 2011

Related U.S. Application Data

(60) Provisional application No. 61/250,769, filed on Oct. 12, 2009.

(51) Int. Cl.
*E21B 21/10* (2006.01)

(52) U.S. Cl.
USPC ..... 175/218; 166/326; 166/91.1

(58) Field of Classification Search ..... 166/373, 166/374, 386, 316, 320, 321, 326, 332.5, 166/91.1; 137/511, 512; 251/336; 175/232, 175/243, 317, 218
See application file for complete search history.

(56) References Cited

U.S. PATENT DOCUMENTS 3,698,426 A * 10/1972 Litchfield et al. ..... 137/512.1
4,128,108 A * 12/1978 Parker et al. ..... 137/327
4,364,407 A * 12/1982 Hilliard ..... 137/71
4,625,755 A * 12/1986 Reddoch ..... 137/327
4,658,905 A * 4/1987 Burge ..... 166/373
6,640,824 B2 * 11/2003 Majkovic ..... 137/71
7,743,787 B2 * 6/2010 Baugh ..... 137/508
7,766,084 B2 * 8/2010 Churchill ..... 166/320

* cited by examiner

*Primary Examiner* — Kenneth L Thompson
(74) *Attorney, Agent, or Firm* — Lemoine & Associates LLC

(57) ABSTRACT

The short mud saver, which can be used with top drive or rotary table drilling system is housed in a short sub, has a large axial bore for the passage of drilling mud therethrough, a fixed and a movable seal assembly. The movable seal assembly is urged into normally closed position by a stack of Belleville, wave or similar disc stack of springs. The force of the spring stack can be over-ridden by application of sufficient mud pressure from top drive or Kelly to move the moveable seal assembly. Upon application of sufficient mud pressure the movable seal assembly moves downward allowing for flow through the large axial bore. Upon closer of the mud saver a flexible washer associated with fixed seal assembly allows pressure below the mud saver to be relieved to the top of the mud saver, from where return is precluded unless the mud saver is re-opened by application of mud pressure from top drive or Kelly. The short mud saver may be integrated with internal, ball-type blow-out preventer and have a shortened retrievable plug.

6 Claims, 8 Drawing Sheets

SHORT MUD SAVER FOR USE WITH TOP DRIVE OR KELLY

This application claims priority arising from U.S. Provisional Patent Application 61/250,769 filed 12 Oct. 2009.

1. FIELD OF THE INVENTION

The invention herein set forth relates generally to the protection of the environment and personnel and for reducing drilling time and cost, by automatically, reducing spillage of drilling mud during drilling of an earth-bore using either Kelly or top drive to rotate the drilling string.

2. GENERAL BACKGROUND

Some rotary drilling rigs use a square or hexagonal pipe, often called the Kelly, which is rotated by a rotary table, to rotate the drill string. A rotary bit located at the bottom of the drill string is commonly use to cut an earth-bore, often referred to as the hole. Drilling fluid, often called drilling mud or simply mud is circulated thru the drill pipe and up the annulus of the hole to, among other reasons, remove the drill cuttings from the hole. Installed between the bottom of the Kelly and the drill pipe may be a mud saver which has a valve which uses a coil spring to close when the drill string is unscrewed, sometimes referred to as broken, from the Kelly. The purpose of the mud saver valve sub is to stop the flow of mud through the Kelly when it is disconnected from the drill string.

Some rotary drilling rigs utilize what is commonly referred to as a top drive to rotate the drill sting. A top drive moves the drill string up and down and rotates it without need of Kelly and rotary table to turn the Kelly. Unfortunately, a top drive has a limitation, namely there is not enough room for a typical mud saver valve sub between the top drive and the drill pipe. The typical mud saver valve used in Kelly drive rotary drilling is too long for use with a top drive. Because of this limitation top drive systems often use a lower inside blow out presented, sometimes called an IBO, to reduce spillage of drilling mud. The top drive will typically have a rotating dog that trips the IBO to close when the drill string is disconnected from the drive assembly. However, the primary purpose of the IBO is to prevent uncontrolled well blow outs thru the inside of the drill pipe. It is risky to use the IBO for mud saving/checking, in that, at some point in it's use, the IBO wears to the point that may not be able to control a blow out, thereby presenting risk to property and personnel.

The time that it takes to close the top drive valve to save or hold the mud in the top drive system and then to later reopen the top drive valve IBO is valuable. A deepwater drilling rig may cost well over 500,000 dollars per day to operate. Drilling at 60 feet per hour, use of the invention disclosed could be expected to reduce time for each connection by at least 2 minutes, resulting in time-for-connection reduction of least an hour per day. This equates into approximately 20,000 dollars a day or more in rig-time savings, in addition to reducing mud costs, increased safety and environmental benefits. Because of the risk it takes to use an IBO to reduce mud spillage some drillers prefer to use a hydraulic mud bucket to catch the mud and transfer the mud to the mud pit system on the rig. This is even more time consuming, and results in utilizing even more, expensive, rig-time that using the IBO to reduce mud spillage.

3. OBJECTS OF THE INVENTION

An object of the disclosed invention include a mud saver having a length sufficiently short that it may be used with top drive drilling system, thereby eliminating the danger and increased time to use an IBO to reduce mud spillage when breaking drill string from the top drive; and, may also be used with drive system which utilizes Kelly and rotary table.

Another object of the disclosed invention is to increase provide a mud saver wherein the flow-through area is increased, pressure drop is decreased, allowing more pressure to be delivered to the drill bit and improving penetration rate, decreasing the velocity of mud through the mud saver, thereby reducing fluid erosion of mud saver components.

Another object of the disclosed invention is to provide top and bottom seals which utilize the static and/or dynamic pressure to open the valve whether circulating down or reverse circulating thru the mud saver valve.

Another object of the disclosed invention is to provide sealing surfaces that are resistant to erosion from flow of abrasive mud.

Another object of the disclosed invention is to provide a retrievable plug that is designed to fit in same space length as moving seal assembly valve seat that can be pulled by tools kept on the rig, so that fishing operations can be performed thru the tool.

Another object of the disclosed invention is to install a flexible type washer that will seal downward flow thru the retrievable plug, while allowing for relief of mud pressure trapped in the drilling pipe; so that when the drill pipe connection is unscrewed, the pressure does not spray out possibly injuring personnel and/or making a mess.

Another alternate embodiment and object of the invention is to provide a means to connect the mud saver of the invention to an IBO, thereby combining the IBOP and the mud saver, saving additional length.

Another object of the invention is to integrally combine the shortened mud saver valve with an inside blow out preventer saving additional length.

Another object of the invention is to make a moving seal assembly that allows the spring set length to fit inside of the upper seal area, further saving additional length.

4. SUMMARY OF THE INVENTION

The mud saver described herein is shortened so as to allow use with a top drive assembly of a drilling rig. The working components of the mud saver are contained in a short sub having box and pin ends. Closure of the mud saver is accomplished by spring moving seal assembly shifting upward against fixed seal assembly. Both moving and fixed seals utilize large diameter valve seats to allow for high mud flow through the mud saver. Valve seats are made of materials which are resistant to wear by flow of abrasive drilling fluid. Spring length is shortened by using stack of Belleville, wave or similar disc shaped washers instead of traditional coil spring. Moving seal assembly may include chamber which contains some of the length of the stack of washers, further shortening the mud saver. Fixed seal assembly is fitted with retrievable plug to permit wireline operations to be conducted through the mud saver. Fixed seal assembly also has ports sealed against downward flow of mud by flexible washer but allows reverse flow thereby relieving pressure that may be trapped in drill pipe attached below the mud saver. The mud saver of the invention is designed to have full flow yet be of short length, allow wifelike operations to be conducted through the mud saver and relieve pressure which may be trapped in drill pipe.

5. BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DESCRIPTION OF THE PREFERRED EMBODIMENT

While the present invention will be described with reference to preferred embodiments, it will be understood by those who are skilled in the art that various changes may be made and equivalents may be substituted for elements thereof without departing from the scope of the invention. In addition, many modifications may be made to adapt a particular situation or material to the teachings of the invention without departing from the essential scope thereof. It is therefore intended that the present invention not be limited to the particular embodiments disclosed as the best mode contemplated for carrying out this invention, but that the invention will include all embodiments and legal equivalents thereof.

Figure 1:
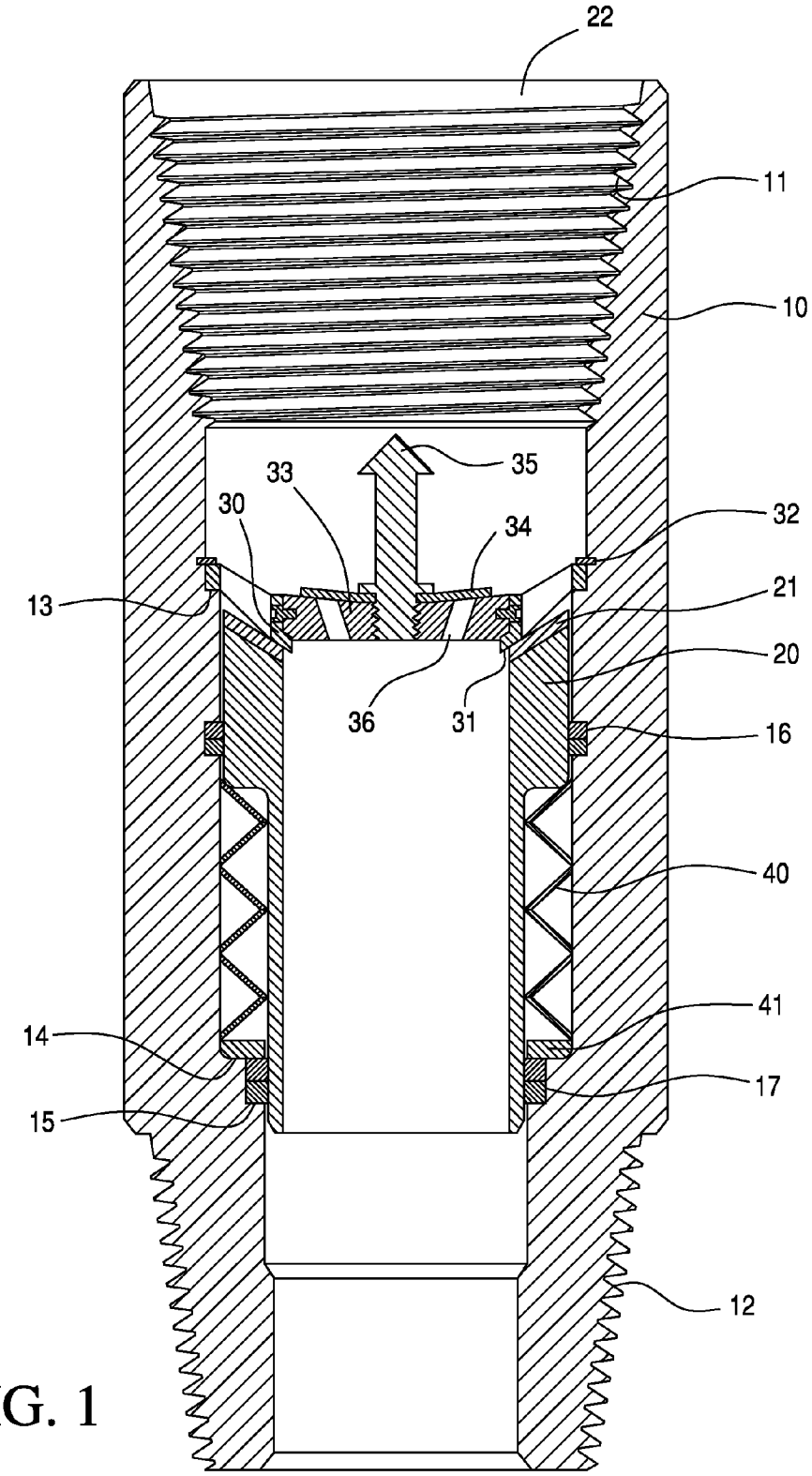
FIG. 1 is a cross section view of the mud saver of the invention in the normally closed position.

Referring to FIG. 1 the mud saver housing, 10, is a short piece of pipe, commonly referred to as a sub, which has a central, axial passageway, 22, for the passage of fluids therethrough. At the upper end of mud saver housing, 10, is a threaded female connection, 11, commonly called the box, box end or box connection. At the lower end of the mud saver housing, 10, is a threaded male connection, 12, commonly called the pin, pin end or pin connection. The female connection, 11, has threads designed to threadingly engage with the threads at the pin end at the bottom of a top drive drilling assembly. The male connection, 12, is designed to threadingly engage with the threads at the box end at the top of a drilling pipe in an earth bore being drilled.

Mud saver housing, 10, includes a sleeve-like moving seal assembly, 20. Moving seal assembly, 20, has axial passageway for the passage of fluids through the mud saver when desired. Movable seal assembly, 20, is slidably disposed along a portion of the axial passageway, 22, of the mud saver housing, 10. The upper surface of moving seal assembly, 20, has a tapered, upwardly-facing, ring-shaped valve seat, 21. Valve seat, 21, may be made of tungsten carbide or other wear resistant material.

Mud saver housing, 10, also includes fixed seal assembly, 30. Fixed seal assembly, 30, is held in place within mud saver housing, 10, by means of vane-like arms, 38, which extend to shoulder, 13, and are held in place against shoulder, 13, by snap ring, 32. The lower surface of fixed seal assembly, 30, has a tapered, downwardly-facing, ring-shaped valve seat, 31. Valve seat, 31, may be made of tungsten carbide or other wear resistant material.

Figure 2:
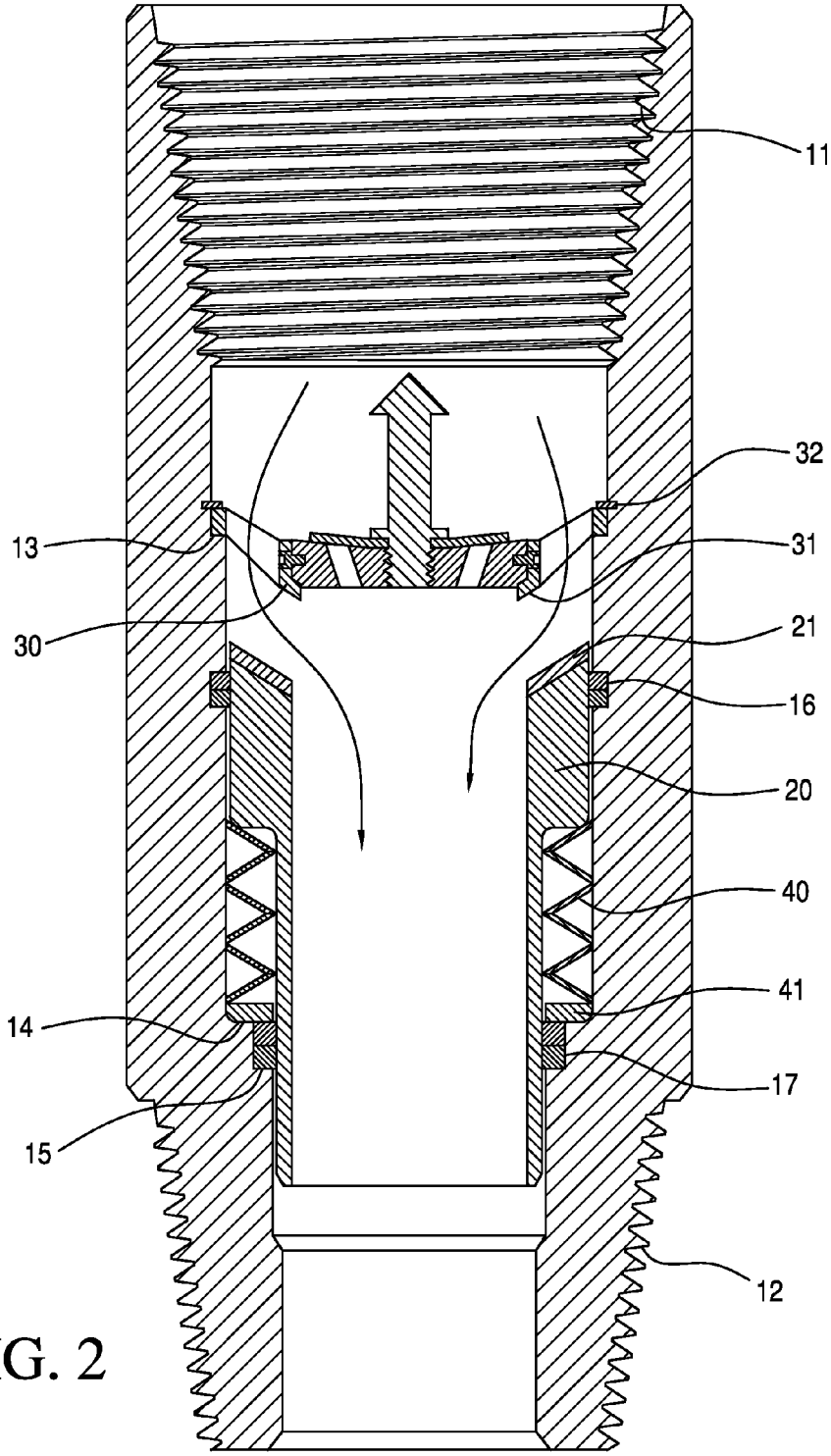
FIG. 2 is a cross section view of the mud saver of the invention in the open position.

The mud saver of the invention is held in a normally closed position, as it is seen in FIG. 1, by means of compression spring, 40, which urges valve seat, 21, of moving seal assembly, 20, into contact with valve seat, 31, of fixed seal assembly, 30, thereby preventing the flow of downward through axial passageway, 22, of mud saver housing, 10, of the mud saver of the invention. The mud saver of the invention may be opened, to allow for the passage of mud from top drive assembly, which is connected to box end, 11, of mud saver housing, 10, into drilling pipe, which is connected to pin end, 12, of mud saver housing, 10, by the application of fluid pressure sufficient to overcome force of spring, 40, to the box end, 11, of mud saver housing, 10. In practice this is accomplished by starting the mud motors of the drilling rig and/or opening a valve which directs mud pressure to the top drive or Kelly. When sufficient pressure is applied moving seal assembly, 20, moves downward, disengaging valve seat, 21, from valve seat, 31, thereby allowing drilling mud to flow through the mud saver housing, 10, as is illustrated in FIG. 2. When valve seat, 21, is disengaged from valve seat, 31, flow of mud is permitted through spaces between vane-like arms, 38, through the center of moving seal assembly, 20, and pin end, 12, of mud saver housing, 10.

Spring, 40, may have washer, 41, to transfer load of the spring, 40, to mud saver housing, 10, and hold lower seals, 17, in place around moving seal assembly 20. Upper seals, 16, are also contained in the mud saver housing, 10, and seal around upper portion of moving seal assembly, 20.

Figure 3:
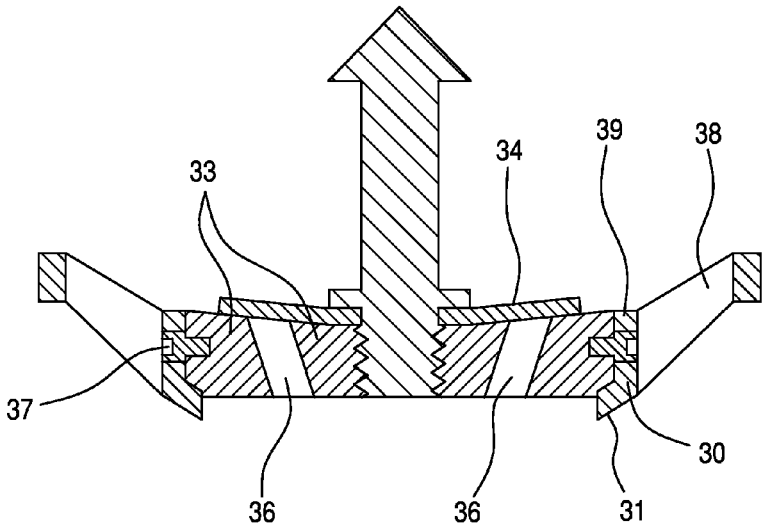
FIG. 3 is a cross section view of the retrievable plug and flow back flexible washer of the invention in the normal closed position.

As seen in FIG. 3, when the pin end, 12, of the mud saver housing, 10, is reconnected to the drill string, the drilling rig mud pumps which circulate mud thru the top drive, mud saver, drill pipe and bit, are turned on and mud pressure acts against the upper seals, 16, and the lower seals, 17. When sufficient mud pressure is applied to overcome spring, 40, moving seal assembly, 20, moves downward allowing mud to flow through axial passageway, 22, of mud saver housing, 10.

Figure 4:
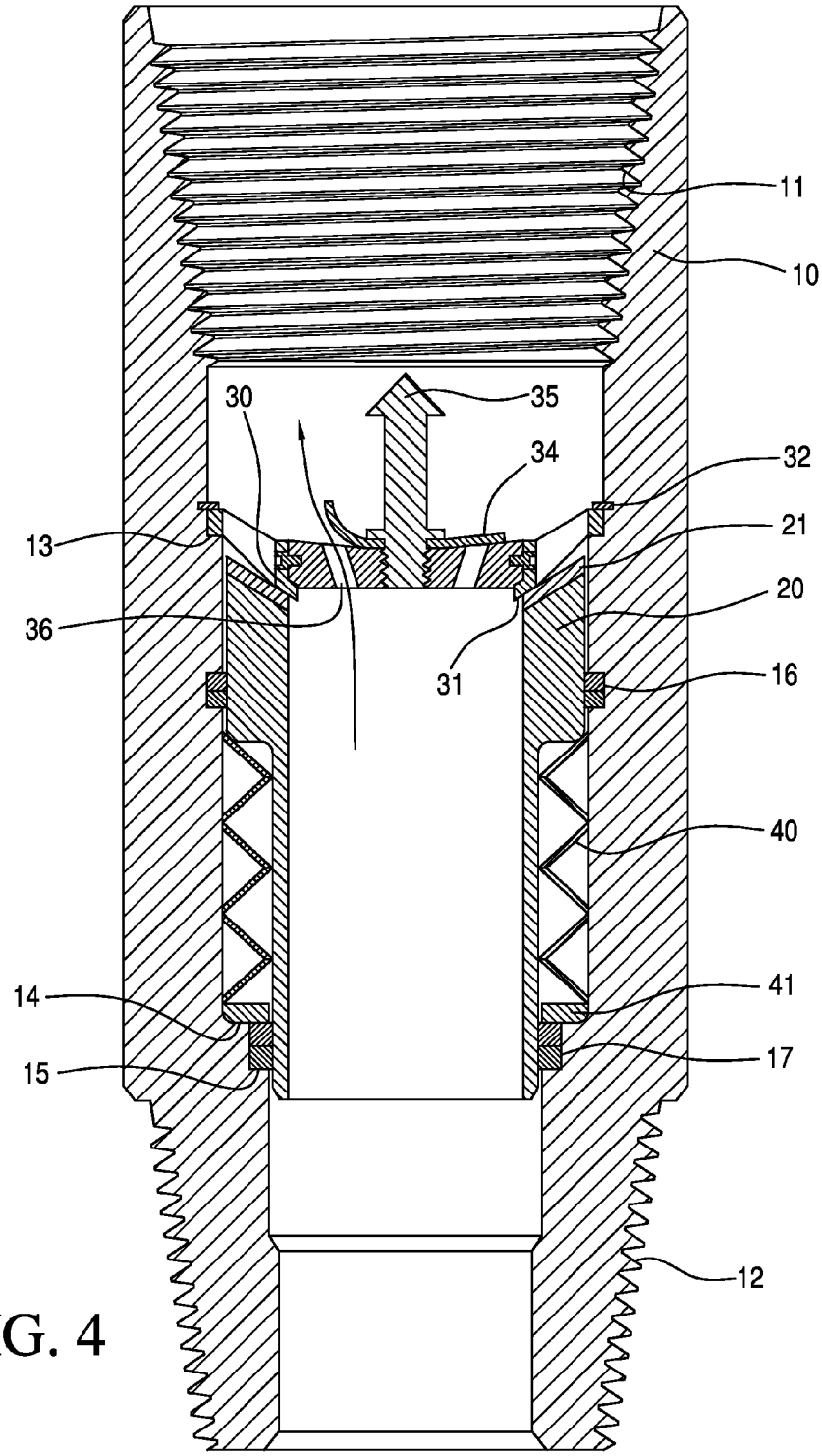
FIG. 4 is a cross section view of the retrievable plug of the invention depicting trapped pressure below valve flowing back under flexible washer of the retrievable plug.

As seen in FIG. 3, retrievable plug, 33, sits in bore of receptacle, 39, of fixed seal assembly, 30. Retrievable plug, 33, may be held in place by one or more pins, 37. Pins, 37, are designed to shear when a selected upward force is applied to retrievable plug, 33, by means of a wire-line latched to spear, 35. Retrievable plug, 33, also has one or more passageways, 36, which are sealed against downward mud flow by flexible washer, 34, but allow upward flow of mud by means of lifting flexible washer, 34, upward as illustrated in FIG. 4. Flexible washer, 34, may be made of rubber, neoprene or other flexible material not adversely affect by chemicals found in drilling mud. Fixed seal assembly, 30, has downward facing, tapered valve seat, 31, which is preferably made of wear resistant material. The tapered side of the valve seat, 31, is intentionally shortened so as to provide for reduction of the length of the mud saver of the invention herein disclosed and claimed, so that retrievable plug, 33, mostly fits in the space provided by the taper of valve seats 21 and/or 31.

As seen in FIG. 4, when the mud saver is in the closed position pressure below fixed seal assembly, 30, is allowed to flow upward, by lifting flexible washer, 34, upward, to backflow through holes, 36, in the retrievable plug, 33. This prevents pressure which may be trapped in the drill pipe from spraying out, possibly injuring personnel, when drill pipe is disconnected from the pin end, 12, of the mud saver. This feature also allows for pressure in the drill pipe to be monitored by pressure sensors upstream the mud saver, allowing drilling rig workers to determine whether they are possibly experiencing pressure from the bottom of the well is coming up through the drill pipe.

Figure 5:
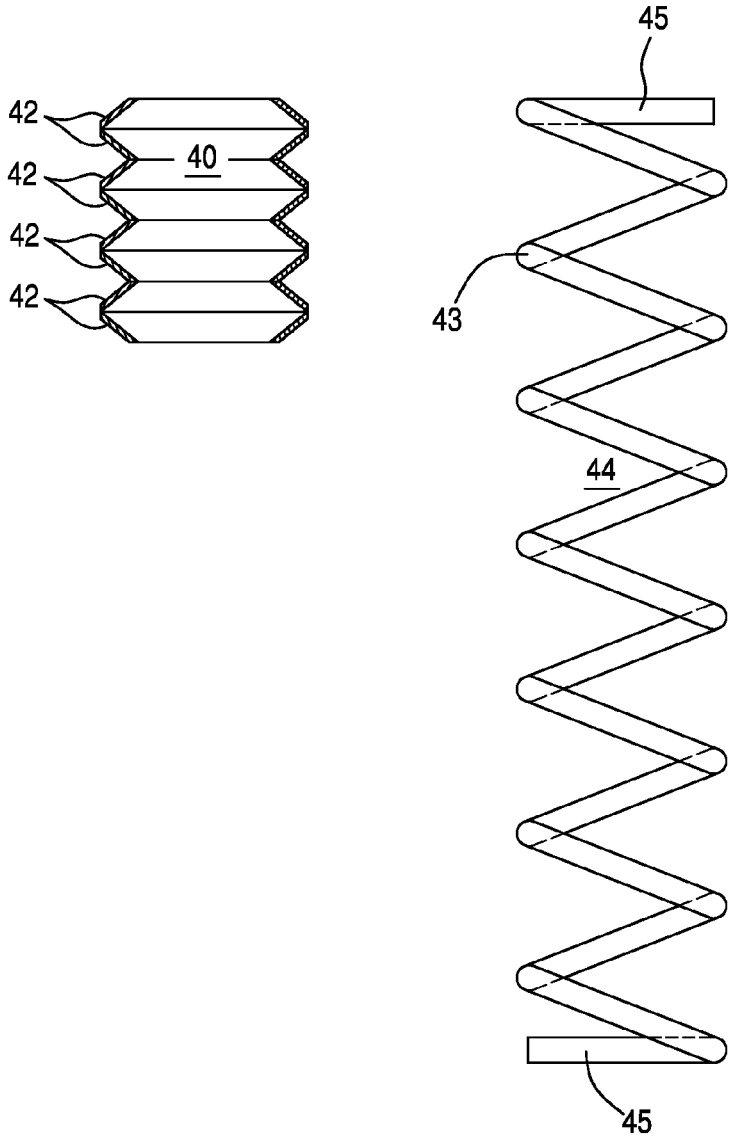
FIG. 5 is a cross section view of coil spring of prior art and a cross section view of a stack of disc washers used in the current design.

As seen in FIG. 5, coil spring, 44, is substantially longer than the stack of disc washers, 40, but both provide similar spring force. The physical difference is that the coil spring, 44, is made of a continuous round wire, 43, with ends, 45, ground to make a flat surface in which to push against, while the spring, 40, is made up of individual discs, 42. Washers commonly referred to as Belleville or wave washers are preferably used in the mud saver of the invention. The coil spring is much longer to accomplish the same goal, but has a lower change in force per unit of deflection, while the stack of disc shaped washers, 40, may be designed to have a high change in force per the same unit of deflection. The washer spring stack, 40, in combination with the other shortening features of the mud saver, 10, provide a mud saver sufficiently short to work with a top drive. The shortness of the mud saver, 10, in no way impairs its function, so may also be used with a rotary table type drive system.

Figure 6:
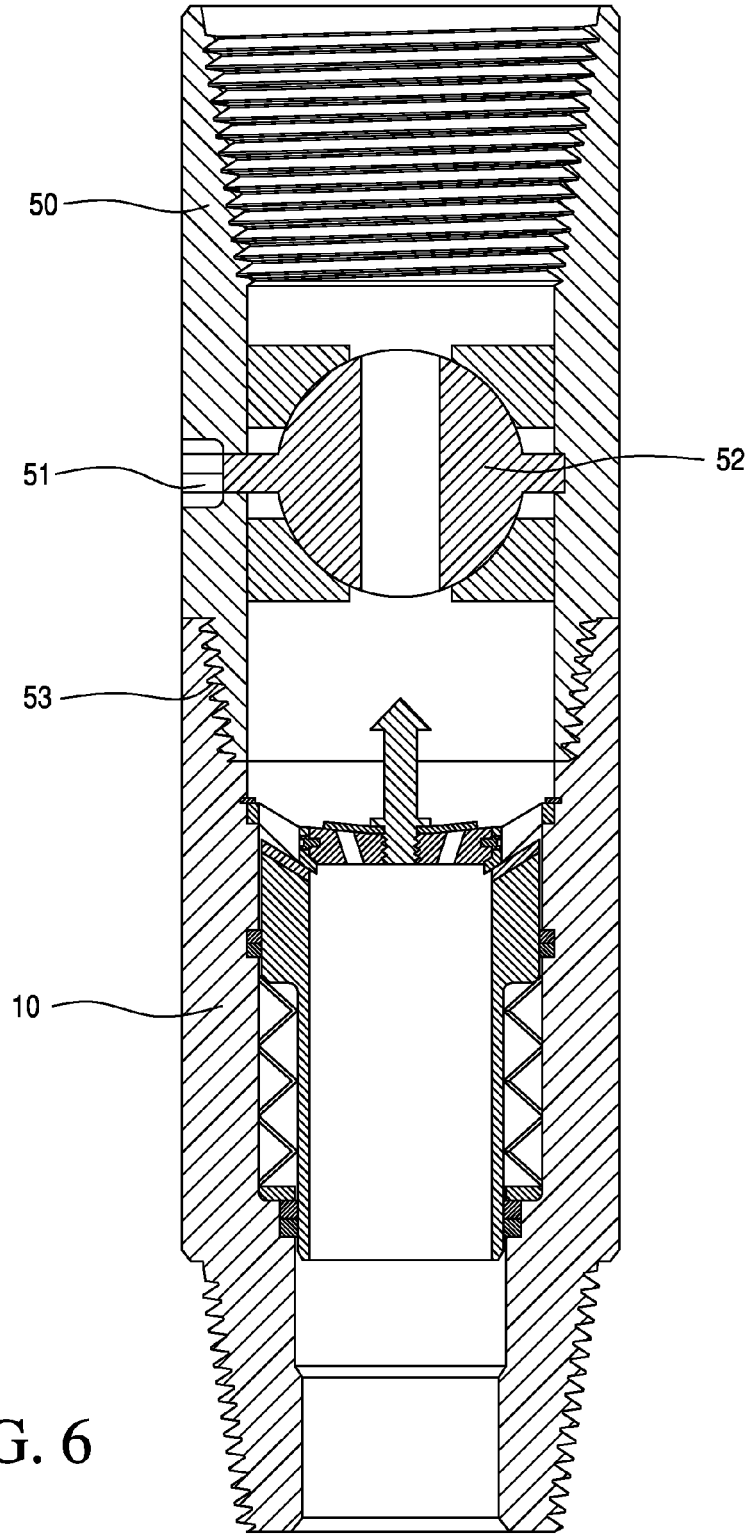
FIG. 6 is a cross section view of the mud saver of the invention screwed into an IBOP.

As seen in FIG. 6 the mud saver, 10, may be screwed into a IBO, 50, that has a mechanical dog, 51, that is mechanically connected to ball, 52. The mechanical dog, 51, may be rotated by the top drive of the drilling rig to close ball, 52, the IBO, 50, thus forming a positive seal against upward flow of pressure from drill pipe to top drive assembly or to the Kelly and may be used as the drill pipe blow out presented in a well control situation.

Figure 7:
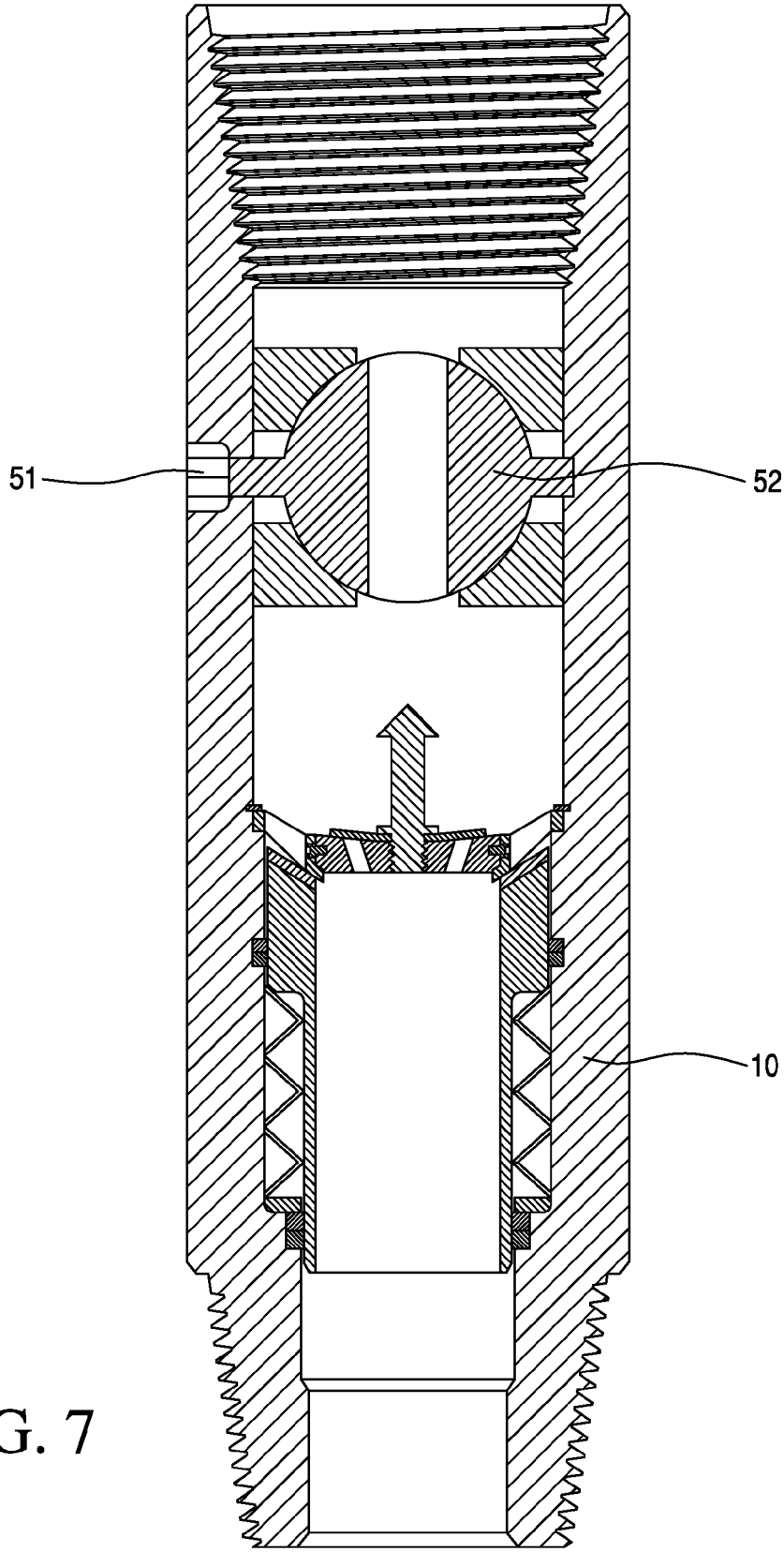
FIG. 7 is a cross section view of the mud saver of the invention integrally fitted with an IBO; and, FIG. 8 is a cross section of a further shortened moving seal assembly of the invention which includes space for spring to collapse within said moving seal assembly.

As seen in FIG. 7, the mud saver, 10, may be equipped with integral ball type closing device, 52, eliminating the need for a separate IBO and additional eliminating threaded connection, 53, thereby providing a shorter combined tool.

Figure 8:
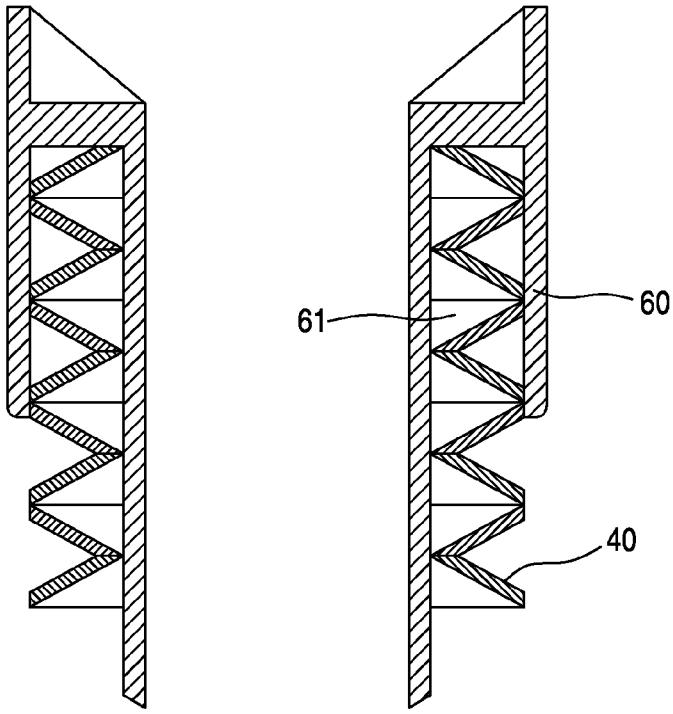

As seen in FIG. 8, a modified moving seal assembly, 60, has chamber, 61, whereby a portion of the stack of spring washers, 40, fit within the bore, 61, thus further reducing the axial length that spring stack, 40, consumes in the mud saver housing, 10.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A shortened mud saver comprising:

a. a cylindrical housing having an axial passageway, a shoulder, a box end adapted to threadingly engage with the pin end of a drive disposed above and a pin end adapted to threadingly engage with the box end of drilling pipe disposed below;

b. a fixed seal assembly having a plurality of vane-like arms attached to an upper portion of the cylindrical housing, said fixed seal assembly comprising a retrievable plug having at least one passageway thereto, a flexible washer disposed over the top of the passageway of said retrievable plug, an upward projecting spear attached to said retrievable plug and a downward facing, ring-shaped, tapered valve seat;

c. a cylindrical-shaped movable seal assembly having a central bore for the passage of fluids therethrough, said movable seal assembly slidably disposed in the axial passageway of said cylindrical housing, said movable seal assembly comprising an upward facing, ring-shaped, tapered valve seat configured to matingly seal with the downward facing, ring-shaped, tapered valve seat of the fixed seal assembly;

d. a compression spring comprised of a stack of disc shaped spring washers operatively disposed between the cylindrical-shaped movable seal assembly and the shoulder of the cylindrical housing for urging said cylindrical-shaped movable seal assembly upward into mating sealing engagement with the fixed seal assembly.

2. The mud saver of claim 1 wherein said compression spring is comprised of a stack of Belleville washers.

3. The mud saver of claim 1 wherein said compression spring is comprised of a stack of wave type washers.

4. The mud saver of claim 1 wherein said movable seal assembly has a downwardly facing chamber configured so as to be able to house at least part of the length of the compression spring.

5. The mud saver of claim 2 wherein said movable seal assembly has a downwardly facing chamber configured so as to be able to house at least part of the length of said stack of the Belville washers.

6. The mud saver of claim 3 wherein said movable seal assembly has a downwardly facing chamber configured so as to be able to house at least part of the length of said stack of the wave type washers.

* * * * *